US009658032B2

(12) United States Patent
Porter et al.

(10) Patent No.: US 9,658,032 B2
(45) Date of Patent: May 23, 2017

(54) INTERLOCKING TURRET SYSTEM

(71) Applicant: Huskemaw Optics, LLC, Cody, WY (US)

(72) Inventors: John Porter, Cody, WY (US); Jack Peterson, Burlington, WY (US); Michael Peterson, Burlington, WY (US)

(73) Assignee: HUSKEMAW OPTICS, LLC, Cody, WY (US)

( * ) Notice: Subject to any disclaimer, the term of this patent is extended or adjusted under 35 U.S.C. 154(b) by 0 days.

(21) Appl. No.: 15/134,926

(22) Filed: Apr. 21, 2016

(65) Prior Publication Data

US 2016/0231085 A1 Aug. 11, 2016

Related U.S. Application Data

(63) Continuation of application No. 14/214,714, filed on Mar. 15, 2014, now Pat. No. 9,366,502.

(60) Provisional application No. 61/793,397, filed on Mar. 15, 2013.

(51) Int. Cl.
*F41G 1/00* (2006.01)
*F41G 1/38* (2006.01)

(52) U.S. Cl.
CPC ..... *F41G 1/38* (2013.01)

(58) Field of Classification Search
CPC ..... F41G 1/38
USPC ..... 42/130
See application file for complete search history.

(56) References Cited

U.S. PATENT DOCUMENTS

| | | | | |
|---|---|---|---|---|
| 4,247,161 | A * | 1/1981 | Unertl, Jr. | G02B 27/36 359/424 |
| D442,252 | S | 5/2001 | Kenton | |
| 6,691,447 | B1 | 2/2004 | Otteman | |
| 7,934,335 | B2 | 5/2011 | Halverson | |
| 8,001,714 | B2 | 8/2011 | Davidson | |
| 8,365,455 | B2 | 2/2013 | Davidson | |
| 8,397,420 | B2 | 3/2013 | Hamilton | |
| 8,413,364 | B2 * | 4/2013 | Riley | G02B 7/004 42/122 |
| 8,928,878 | B2 * | 1/2015 | Jaeschke | G02B 27/36 33/298 |
| 9,057,586 | B2 * | 6/2015 | Wagner | F41G 1/38 |
| 9,354,438 | B2 * | 5/2016 | Ingenito | F41G 1/38 |

(Continued)

FOREIGN PATENT DOCUMENTS

WO 2012119574 A1 9/2012

*Primary Examiner* — Samir Abdosh
(74) *Attorney, Agent, or Firm* — Husch Blackwell LLP

(57) ABSTRACT

A turret system for use with a firearm scope is provided, wherein the turret system comprises a plurality of turrets connected in an interlocked and telescoping orientation. The system may include a first turret having a hollow body and a second turret that may be at least partially received within the hollow body of the first turret. The first turret can be selectively axially movable relative to the second turret such that the second turret may be at least partially exposed when the first turret is in a raised position and the second turret may be substantially covered when the first turret is in a lowered position. The first turret may include a first set of calibration data thereon tailored to a first set of shooting conditions and the second turret may include a second set of calibration data thereon tailored to a second set of shooting conditions.

22 Claims, 7 Drawing Sheets

(56) References Cited

U.S. PATENT DOCUMENTS

| | | | | |
|---|---|---|---|---|
| 2003/0145505 | A1 | 8/2003 | Kenton | |
| 2003/0192224 | A1 | 10/2003 | Kirk | |
| 2005/0021282 | A1 | 1/2005 | Sammut et al. | |
| 2007/0240356 | A1* | 10/2007 | Klepp | F41G 1/38 42/122 |
| 2008/0007843 | A1 | 1/2008 | Schafer | |
| 2008/0066364 | A1* | 3/2008 | Klepp | F41G 1/38 42/122 |
| 2009/0241399 | A1 | 10/2009 | Hamilton | |
| 2011/0061285 | A1 | 3/2011 | Hamilton | |
| 2012/0147488 | A1* | 6/2012 | Riley | G02B 7/004 359/811 |
| 2012/0154907 | A1 | 6/2012 | Schmitt et al. | |
| 2012/0186131 | A1* | 7/2012 | Windauer | F41G 1/38 42/122 |
| 2012/0266515 | A1 | 10/2012 | Hamilton | |
| 2013/0174490 | A1 | 7/2013 | Crispin et al. | |
| 2013/0232846 | A1* | 9/2013 | Wagner | F41G 1/38 42/119 |
| 2014/0002815 | A1* | 1/2014 | Jaeschke | G02B 27/36 356/247 |
| 2015/0068099 | A1 | 3/2015 | Hamilton | |
| 2015/0070758 | A1 | 3/2015 | Ingenito | |
| 2015/0268001 | A1* | 9/2015 | Porter | F41G 1/38 42/130 |

* cited by examiner

INTERLOCKING TURRET SYSTEM

CROSS-REFERENCE TO RELATED APPLICATIONS

This Application is a Continuation of and claims priority to U.S. application Ser. No. 14/214,714, filed on Mar. 15, 2014, to John Porter et al. entitled "Interlocking Turret System," the entire disclosure of which is incorporated herein by reference, which in turn claims priority to U.S. Provisional Patent Application Ser. No. 61/793,397, filed on Mar. 15, 2013, to John Porter et al. entitled "Interlocking Turret System," the entire disclosure of which is also incorporated herein by reference.

BACKGROUND OF THE INVENTION

Telescopic sights, commonly referred to as scopes, are often used in connection with firearms to assist hunters, military personnel and target shooters in aiming at desired targets. Typically, a scope is mounted to a firearm such that a shooter may look through the scope to view and aim at a target. A number of shooting conditions impact the trajectory of a bullet upon being fired. Such shooting conditions include, for example, gravity, distance to the target, wind speed, wind direction, elevation relative to sea level, air temperature, barometric pressure, relative humidity and air density, in addition to the bullet's caliber, weight, muzzle velocity and ballistics coefficient. Upon a change in one or more of these conditions, a user typically is required to adjustment the scope in order to account for such change. Adjustments to the scope may be made by turning an adjustment dial or turret. Conventional turrets include incremental markings that indicate the amount of adjustment undertaken through the turret's rotation.

Users often desire to use a single scope in a variety of shooting conditions. For example, in one instance a user may want to use the scope at a low elevation location having a high air density, while in another instance the user may want to use the same scope at a high elevation location having a low air density. Users also routinely use a single scope to shoot at targets at a variety of distances. In a single hunt or mission, a user will want the ability to shoot at targets both near and far. Additionally, users regularly use a single scope with a variety of ammunition. For example, in one instance a user may use the scope while shooting a first bullet having a first weight and ballistics coefficient, while in another instance the user may use the same scope while shooting a second bullet having a second weight and ballistics coefficient. Further, users sometimes desire to swap a single scope between two or more firearms. A typical scope may include a turret that can adjust the scope to account for some of these shooting condition changes, however, there is a limit to the adjustment that a single turret can make.

U.S. Pat. Nos. 8,001,714 and 8,365,455 to Aaron Davidson, both entitled "Ballistics Systems and Methods," teach a system and method for making turrets that are customized to the shooting conditions under which the scope and firearm are expected to be used. Different turrets may be created for different shooting conditions. Davidson also teaches a system wherein a plurality of turrets may be interchangeably used with a single scope. As such, a first turret may be used when the user is shooting in a first set of shooting conditions and a second turret may be used when the user is shooting in a second set of shooting conditions.

Shooting conditions can change almost instantaneously during a single hunt or mission. For example, the distance to a specific target may change or the decision to use a different type of bullet may occur within a matter of seconds. However, as taught by Davidson, in order to exchange one turret with another turret, the user must disconnect and remove the first turret from the scope and replace it with the second turret. The task of disconnecting and removing one turret and replacing it with another turret requires an amount of time that can be the difference between getting a shot off and not getting a shot off. In the case of a hunter, this amount of time may allow the hunted game to escape the hunter's line of sight or range. In the case of a military marksman, this amount of time may allow an enemy combatant to escape the marksman's line of sight or range or even allow the enemy combatant to fire a shot at the marksman.

Further yet, when multiple interchangeable turrets are used in connection with a single scope, the turrets, when not in use (i.e., detached to the scope), are loose parts that become easily lost.

Accordingly, a need exists for a turret system that is suitable and calibrated for use in a variety of shooting conditions. A need also exists for a turret system that provides a user with instant access to multiple turrets thereby enabling a user to quickly adjust a scope upon a change in shooting conditions. A further need exists for a turret system having multiple turrets concurrently attached to a single scope, each turret being customized for a specific set of shooting conditions.

SUMMARY OF THE INVENTION

One embodiment of the present invention is directed generally to a turret system for use with a firearm scope that includes a plurality of turrets arranged in an interlocked and telescoping orientation. First and second turrets may be provided wherein the first turret includes a hollow body and the second turret may be at least partially received within the hollow body of the first turret. The first turret can be selectively axially movable relative to the second turret such that the second turret can be at least partially exposed when the first turret is in an extended or raised position, and the second turret may be substantially covered when the first turret is in a collapsed or lowered position.

The first turret may be provided with a first set of calibration data included thereon tailored to a first set of shooting conditions. Similarly, the second turret may be provided with a second set of calibration data included thereon tailored to a second set of shooting conditions. When the first turret is in an extended or raised position, the second set of calibration data on the second turret may be at least partially exposed or visible. Conversely, when the first turret is in a collapsed or lowered position, the second set of calibration data on the second turret may be substantially covered or hidden.

The first set of calibration data on the first turret can include a first set of distance indicators and a first set of windage hold-off indicators. Similarly, the second set of calibration data on the second turret can include a second set of distance indicators and a second set of windage hold-off indicators. Alternatively, either one or both the first and second turrets may include minute of angle (MOA) data.

The first and second turrets can be rotationally interlocked with one another so that the first and second turrets are together rotatable relative to the scope. For example, if the first turret is rotated one-quarter of a revolution, the second turret is also rotated one-quarter of a revolution. In one embodiment, the first and second turrets are rotationally interlocked together through a splined engagement. In such an embodiment, the first turret includes a plurality of internal splines on an inner surface of the first turret and the second turret includes a plurality of corresponding external splines on an outer surface of the second turret suitable for engaging the internal splines of the first turret. Alternative to splines, it will be appreciated that the first and second turrets may be rotationally interlocked together through a projection or recess associated with an inner surface of the first turret that corresponds to and engages a recess or projection associated with an outer surface of the second turret.

It will be appreciated that the turret system of the present invention may include any suitable number of a plurality of turrets (e.g., two, three, four, five, etc.). In one embodiment, a third turret is provided. The third turret may be at least partially received within the second turret. In this embodiment, the second turret is selectively axially movable relative to the third turret such that the third turret is at least partially exposed when the second turret is in an extended or raised position, and the third turret is substantially covered when the second turret is in a collapsed or lowered position.

The third turret may be provided with a third set of calibration data included thereon that is tailored to a third set of shooting conditions. When the second turret is in an extended or raised position, the third set of calibration data on the third turret may be at least partially exposed or visible. Conversely, when the second turret is in a collapsed or lowered position, the third set of calibration data on the third turret may be substantially covered or hidden.

During use of the scope, one or more of shooting conditions may change. Such changes in shooting conditions may include at least one of, for example, a change in the distance to the target, a change in bullet, a change in elevation or a change in temperature. Turrets are typically tailored for a specific set of shooting conditions or range of shooting conditions. Once the shooting conditions fall outside of the range of shooting conditions for which a turret is tailored, the turret may become ineffective in accurately adjusting the scope. In other words, when there are dramatic differences between a first set of shooting conditions and a second set of shooting conditions, a second turret that is tailored for a range of shooting conditions that includes the second set of shooting conditions is required in order to accurately adjust the scope. With the present invention, the first turret may be lifted so that the second turret, or even a third or subsequent turret, may be exposed and visible to the user.

Such a system eliminates the required task of having to disconnect and remove one turret from the scope and replacing it with another turret. Instead, by simply pulling up on one of the turrets (e.g., the first turret), the user instantaneously has access to another turret (e.g., the second turret) which may be tailored for a different set of shooting conditions or range of shooting conditions.

Other aspects and advantages of the present invention will be apparent from the following detailed description of the preferred embodiments and the accompanying drawing figures.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
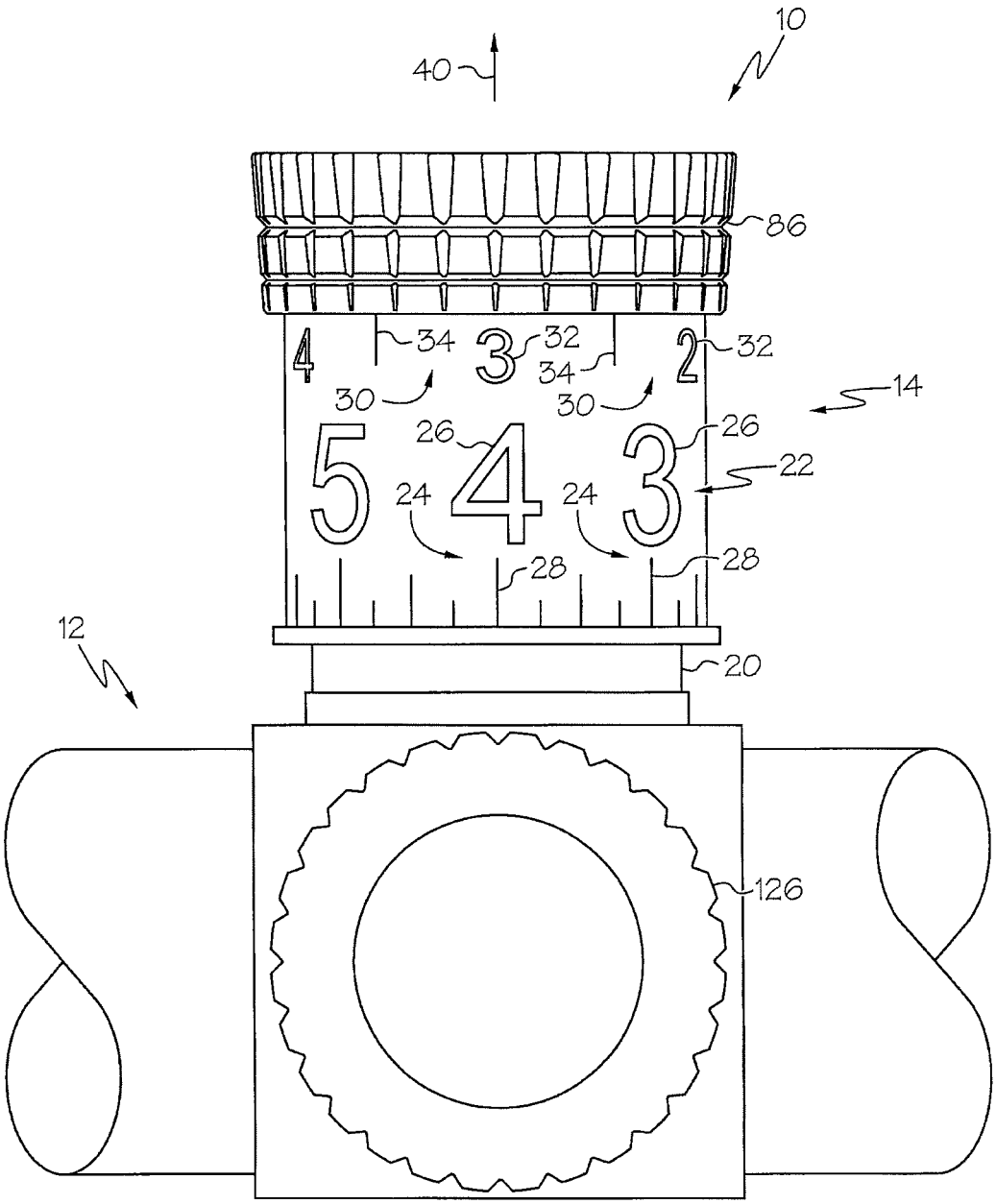
FIG. 1 is a side view of an interlocking turret system constructed according to one embodiment of the present invention illustrating the turrets in a fully collapsed orientation.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally to a turret system 10 as part of a scope 12 configured for attachment to a firearm (not shown). The turret system 10 comprises two or more turrets 14, 16 or 18 arranged in an interlocked, stacked, layered, expandable, retractable, extendable, collapsible and/or telescoping orientation. As illustrated in FIGS. 1-6, one embodiment of the present invention includes three turrets 14, 16 and 18; however it will be appreciated that any number of a plurality of turrets (e.g., two, three, four, five, etc.) are also within the scope of the present invention.

Each turret 14, 16 and 18 may optionally be constructed in accordance with the teachings of U.S. Pat. Nos. 8,001,714 and 8,365,455 to Aaron Davidson, both entitled "Ballistics Systems and Methods" (collectively referred to herein as "Davidson"), the entire disclosures of which are incorporated herein by reference. For example, each turret 14, 16 and 18 may include calibration data 22, 42 and 62, respectively, as further discussed below, that is customized or tailored for a specific set of expected shooting conditions. As used herein the term "shooting conditions" may include one or more of the following: gravity, distance to a target, wind speed, wind direction, elevation relative to sea level, air temperature, barometric pressure, relative humidity air density, bullet caliber, bullet weight, bullet muzzle velocity and bullet ballistics coefficient. The term shooting conditions may also include or refer to specific ranges for each of these listed conditions, the ranges having generally defined upper and lower limits.

Turning to FIG. 1, the turret system 10 is depicted in a fully collapsed orientation with only the first turret 14 being visible. In this instance, the remainder of the turrets 16 and 18 remain covered. As shown, the turret system 10 is mounted to a base 20 projecting upwardly from the scope 12. The first turret 14 may include a first set of calibration data 22 that is customized or tailored to a first set of shooting conditions. By way of a non-limiting example, the first set of calibration data 22 may be adapted for a .308 bullet having a weight of 168 grains and a G1 ballistics coefficient of 0.496 that is expected to be fired at a distance up to 950 yards at an elevation of 6,000 feet above sea level in air having a temperature of 40° F., relative humidity of 50% and air density of 0.063 lbm/ft$^3$. Of course, in other examples and embodiments, the first set of calibration data 22 may be adapted for other shooting conditions.

The first set of calibration data 22 may include one more distance indicators 24 configured to indicate a distance to a target. As is known, a first distance indicator 24 may indicate a first distance to a target and a second distance indicator 24 may indicate a second distance to a target. Desirably, when the first distance indicator 24 is aligned with a reference mark (not shown) on the scope 12, the scope 12 is preferably configured to compensate for a first projectile drop associated with the first distance, and when the second distance indicator 24 is aligned with the scope's reference mark, the scope 12 is preferably configured to compensate for a second projectile drop associated with the second distance. The distance indicators 24 may include, for example, numbers 26 or other symbols indicating a distance to a target. The distance indicators 24 may also include reference marks 28 which may be associated with the numbers 26 or symbols. The distance indicators 24, however, do not require numbers 26 or symbols and may simply include reference marks 28, if desired.

The first set of calibration data 22 may also optionally include one or more windage hold-off indicators 30 configured to indicate a hold-off to compensate for an amount of deflection caused by a crosswind. A first windage hold-off indicator 30 may indicate a first hold-off for a first amount of crosswind deflection and a second hold-off indicator 30 may indicate a second hold-off for a second amount of crosswind deflection. The amount of hold-off is dependent upon the speed of the crosswind, the direction of the crosswind and distance to the target, among other factors. An exemplary windage hold-off indicator 28 may include, for example, a number 32 or other symbol indicating a hold-off for an amount of crosswind deflection. The windage hold-off indicator 30 may also include reference marks 34 which may be associated with the numbers 32 or symbols. The windage hold-off indicators 30, however, do not require any numbers 32 or symbols and may simply include reference marks 34, if desired. As taught by Davidson, the windage hold-off indicators 30 may advantageously allow a user to quickly and easily apply a hold-off tailored to a selected distance to a target by aligning the target with a harsh mark or dot on the scope's reticle (not shown) that is associated with a particular hold-off indicator 30.

During use of the scope 12, one or more of the shooting conditions may change. Non-limiting examples of such changes in the shooting conditions are provided herein for illustrative purposes. One shooting condition that may change is distance to the target. Rather than the target being at located a distance of 950 yards, as provided in the example above, the target may be located at a shorter distance (e.g., 500 yards) or longer distance (e.g., 1,200 yards). Another shooting condition that may change is the type of bullet. Rather than the bullet being a .308 bullet having a weight of 168 grains and a G1 ballistics coefficient of 0.496, as provided in the example above, the bullet may be a .308 bullet of a lesser weight (e.g., 155 grains) or a greater weight (e.g., 210 grains) and may have a smaller G1 ballistics coefficient (e.g., 0.439) or a larger G1 ballistics coefficient (e.g., 0.631). The user may even mount the scope 12 on a different firearm that shoots a different caliber of bullet (e.g., 7 mm rifle or .338 Lapua Magnum rifle). Another shooting condition that may change is elevation. Rather than being located at 6,000 feet above sea level, as provided in the example above, the user may be located at a lower elevation (e.g., 1,000 feet) or a higher elevation (e.g., 10,000 feet). Yet another shooting condition that may change is air temperature. Rather than the air temperature being 40° F., as provided in the example above, the air temperature may be lower (e.g., 10° F.) or higher (e.g., 60° F.). An additional shooting condition that may change is relative humidity. Rather that the relative humidity being 50%, as provided in the example above, the relative humidity may be lower (e.g., 30%) or higher (e.g., 70%). Further, based on changes in elevation, temperature, relative humidity and other atmospheric conditions, the air density may also change. Rather than the air density being 0.063 lbm/ft$^3$, as provided in the example above, the air density may be lower (e.g., 0.058 lbm/ft$^3$) or higher (e.g., 0.073 lbm/ft$^3$). Shooting conditions other than those discussed herein may also change. It will be appreciated that the shooting conditions can change almost instantaneously during a single hunt or mission. For example, the distance to a specific target may change or the decision to use a different type of bullet may occur within a matter of seconds.

When shooting conditions change, the user must adjust the scope 12 to accommodate for such changes. Turrets are typically tailored for a specific set of shooting conditions or range of shooting conditions. Once the shooting conditions fall outside of the range of shooting conditions for which a turret is tailored, the turret may become ineffective in accurately adjusting the scope 12. In other words, when there are dramatic differences between a first set of shooting conditions and a second set of shooting conditions, a second turret that is tailored for a range of shooting conditions that includes the second set of shooting conditions is required in order to accurately adjust the scope 12. Again, shooting conditions may change dramatically in a matter of seconds thereby not allowing the time necessary for disconnecting and removing one turret from the scope 12 and replacing it with another turret.

Figure 2:
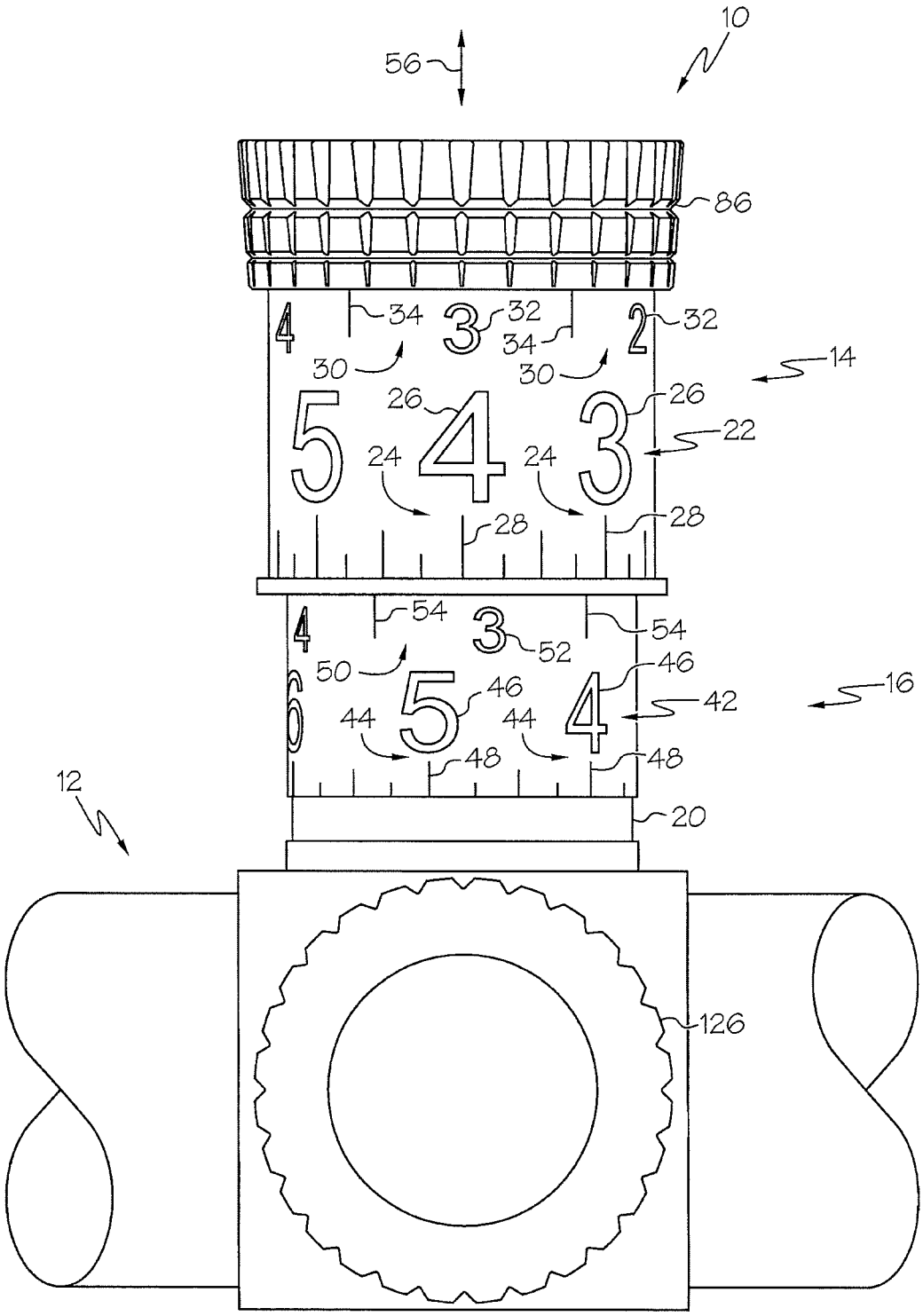
FIG. 2 is a side view of an interlocking turret system constructed according to one embodiment of the present invention illustrating the turrets in a partially expanded orientation.

As illustrated in FIG. 2, the turret system 10 includes a second turret 16 that is readily accessible by raising the first turret 14. As shown in FIGS. 2 and 6, the first turret 14 includes a hollow body comprising a sidewall 36 defining an internal cavity 38. The second turret 16 may be partially or fully received within the cavity 38 of the first turret's hollow body. As indicated by arrow 40 in FIG. 1, the first turret 14 may be selectively pulled upwardly along a longitudinal axis A-A to at least a partially raised or extended position in order to reveal the second turret 16. In that manner, the first turret 14 is axially movable not only relative to the scope 12, but also relative to the second turret 16. In the embodiment shown in FIGS. 1-6, which includes three turrets 14, 16 and 18, the first turret 14 can be movable to a partially extended position, as shown in FIG. 2, in order to expose the second turret 16. As demonstrated by FIG. 2, when the first turret 14 is in an extended or partially extended position, the second turret 16 and the second set of calibration data 42 included thereon may be at least partially or fully exposed or visible. As demonstrated by FIG. 1, when the first turret 14 is in a fully collapsed or lowered position, the second turret 16 and the second set of calibration data 42 included thereon are substantially covered or hidden.

The second turret 16 can include a second set of calibration data 42 that may be similar in nature to the first set of calibration data 22 included on the first turret 14, albeit the second set of calibration data 42 may be tailored for a second set of shooting conditions. The second set of calibration data 42 may include one more distance indicators 44 configured to indicate a distance to a target. As discussed above with respect to the first set of distance indicators 24, the second set of distance indicators 44 can include one or more numbers 46, symbols or reference marks 48. Similarly, the second set of calibration data 42 may optionally comprise a second set of windage hold-off indicators 50, which may include one or more numbers 52, symbols or reference marks 54.

The distance indicators 44 of the second set of calibration data 42 may be for distances that are different (e.g., longer distances) than the distances associated with the distance indicators 24 of the first set of calibration data 22. For example, while the first set of calibration data 22 may be tailored for distances up to 950 yards, the second set of calibration data 42 may be tailored for distances between 975 yards and 1,250 yards. In another embodiment, the second set of calibration data 42 may be tailored for a different type of bullet or a different elevation, for example. It will be appreciated that any number of shooting conditions may be used in developing the second set of calibration data 42 included on the second turret 16.

As indicated by arrow 56 in FIG. 2, the first turret 14 may be selectively pulled further upwardly along a longitudinal axis A-A to a fully extended position in order to reveal the third turret 18 and, optionally, subsequent turrets (not shown). As also indicated by arrow 56, the first turret 14 may be selectively pushed downwardly to a fully collapsed position in order to at least partially or fully cover the second turret 16.

Figure 3:
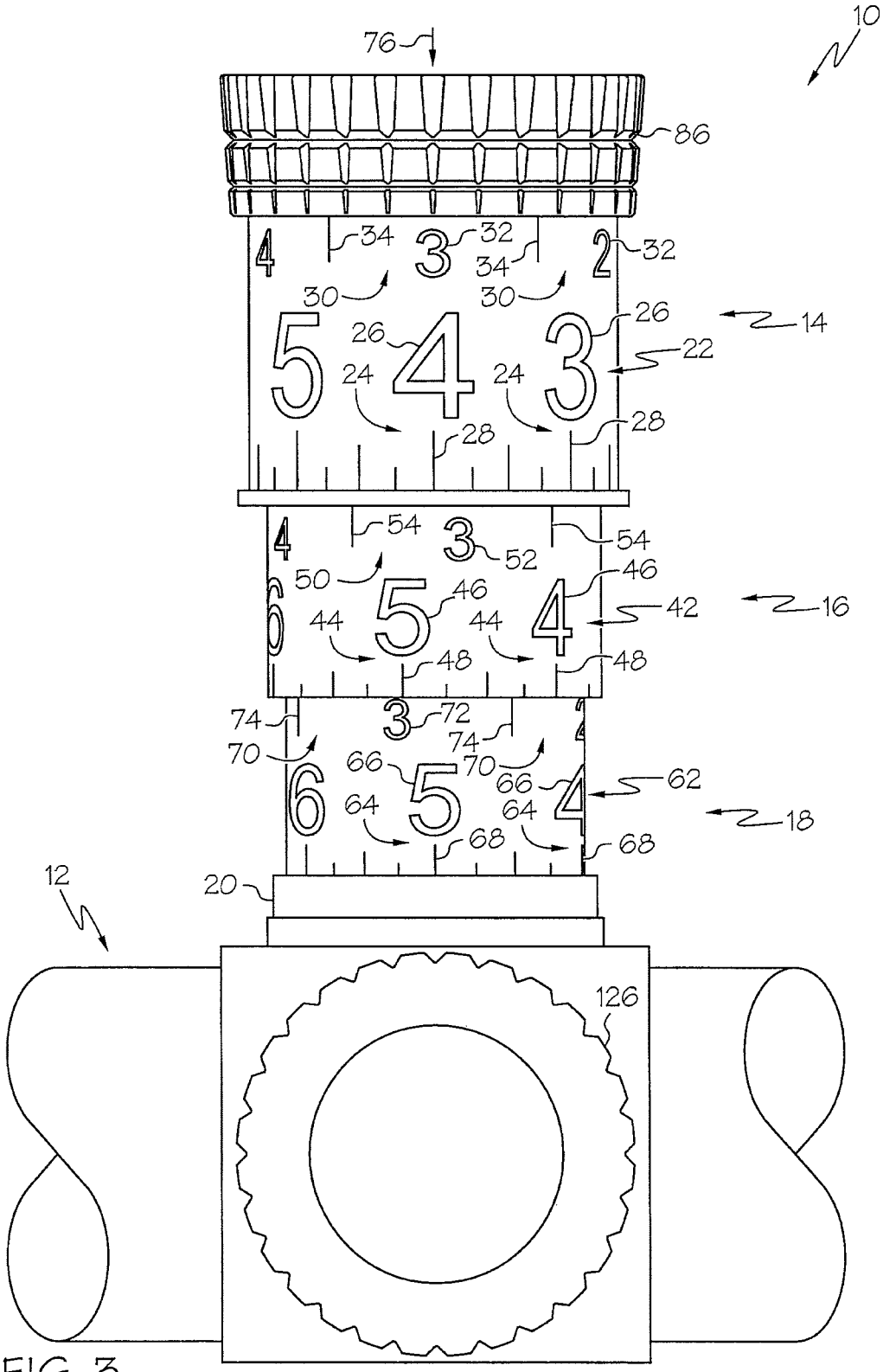
FIG. 3 is a side view of an interlocking turret system constructed according to one embodiment of the present invention illustrating the turrets in a fully expanded orientation.

FIG. 3 illustrates an embodiment of the turret system 10 in a fully extended orientation thereby exposing the third turret 18. As shown in FIGS. 3 and 6, the second turret 16 includes a hollow body comprising a sidewall 58 defining an internal cavity 60. The third turret 18 may be partially or fully received within the cavity 60 of the second turret's hollow body. As depicted in FIG. 3, when the turret system 10 is in a fully extended orientation, the third turret 18 and a third set of calibration data 62 included thereon may be at least partially or fully exposed or visible. Similarly, as depicted in FIGS. 1 and 2, the third turret 18 is covered or hidden when the first turret 14 is in a collapsed or lowered position or in a partially extended or raised position.

The third turret 18 can include a third set of calibration data 62, which may be similar in nature to the first and second sets of calibration data 22 and 42 included on the first and second turrets 14 and 16, respectively, albeit the third set of calibration data 62 may be tailored for a third set of shooting conditions. The third set of calibration data 62 may include one more distance indicators 64 configured to indicate a distance to a target. As discussed above with respect to the first and second sets of distance indicators 24 and 44, the third set of distance indicators 64 can include one or more numbers 66, symbols or reference marks 68. Similarly, the third set of calibration data 62 may optionally comprise a third set of windage hold-off indicators 70, which may include one or more numbers 72, symbols or reference marks 74.

The distance indicators 64 of the third set of calibration data 62 may be for distances that are different (e.g., longer distances) than the distances associated with the distance indicators 24 and 44 of the first and second sets of calibration data 22 and 42. For example, while the first set of calibration data 22 may be tailored for distances up to 950 yards and the second set of calibration data 42 may be tailored for distances between 975 yards and 1,250 yards, the third set of calibration data 62 may be tailored for distances between 1,275 and 1,550 yards, for example. Since the user has immediate access to multiple stacked turrets 14, 16 and 18, the user may virtually instantaneously select the turret 14, 16 or 18 corresponding with the distance to the user's target. By using a set of stacked or interlocking turrets 14, 16 and 18, the user can have the needed turret at the needed time. In other embodiments, the third set of calibration data 62 may be tailored for a different type of bullet or a different elevation, for example. If the user opts to switch bullets, the user may select the turret 14, 16 or 18 corresponding with the bullet the user desires to fire. Notwithstanding the foregoing, it will be appreciated that any number of shooting conditions may be used in developing the third set of calibration data 62 included on the third turret 18. It will further be understood that the turrets 14, 16 and 18 may each include a notation describing the shooting conditions for which each turret 14, 16, and 18 is designed, like that shown in FIGS. 5 and 6 of the Davidson patents.

As indicated by arrow 76 in FIG. 3, the first turret 14 may be selectively pushed downwardly along a longitudinal axis A-A to a fully collapsed or partially collapsed position in order to re-cover the third turret 18 and, optionally, the second turret 16 as well.

Figure 4:
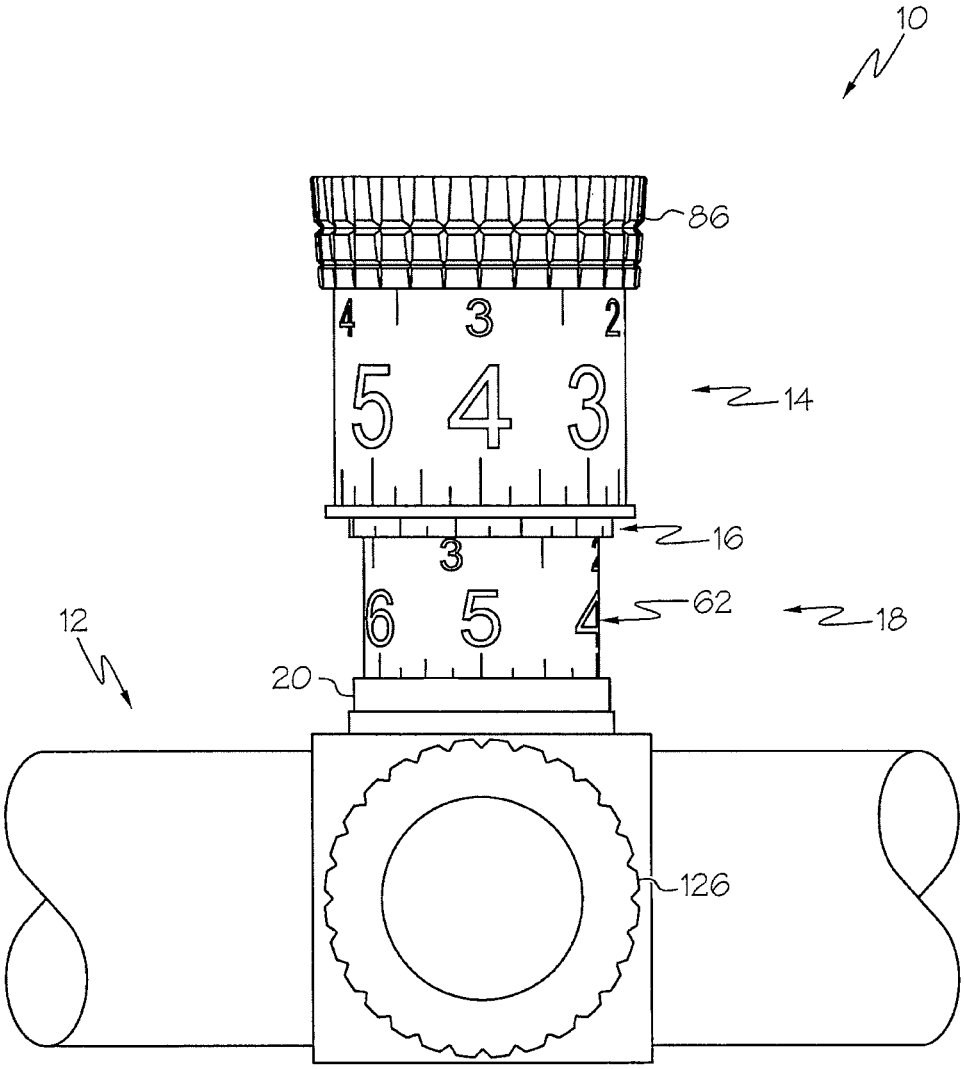
FIG. 4 is a side view of an interlocking turret system constructed according to one embodiment of the present invention illustrating a first turret in an expanded orientation and a second turret in a raised position to reveal a third turret.

Turning to FIG. 4, it will be appreciated that in one embodiment the first turret 14 need not be raised to the fully extended level demonstrated in FIG. 3 in order to at least partially expose the third turret 18 or the third set of calibration data 62 included thereon. Rather, as depicted in FIG. 4, the second turret 16 may be slid upwardly wholly or partially into the hollow body cavity 38 of the first turret 14 in order to expose the third turret 18 and third set of calibration data 62. In an embodiment that includes additional turrets (not shown) (e.g., fourth turret, etc.), such additional turrets and calibration data thereon may also be at least partially exposed by similarly sliding the third turret 18 upward into the hollow body cavity 60 of the second turret 16.

Figure 5:
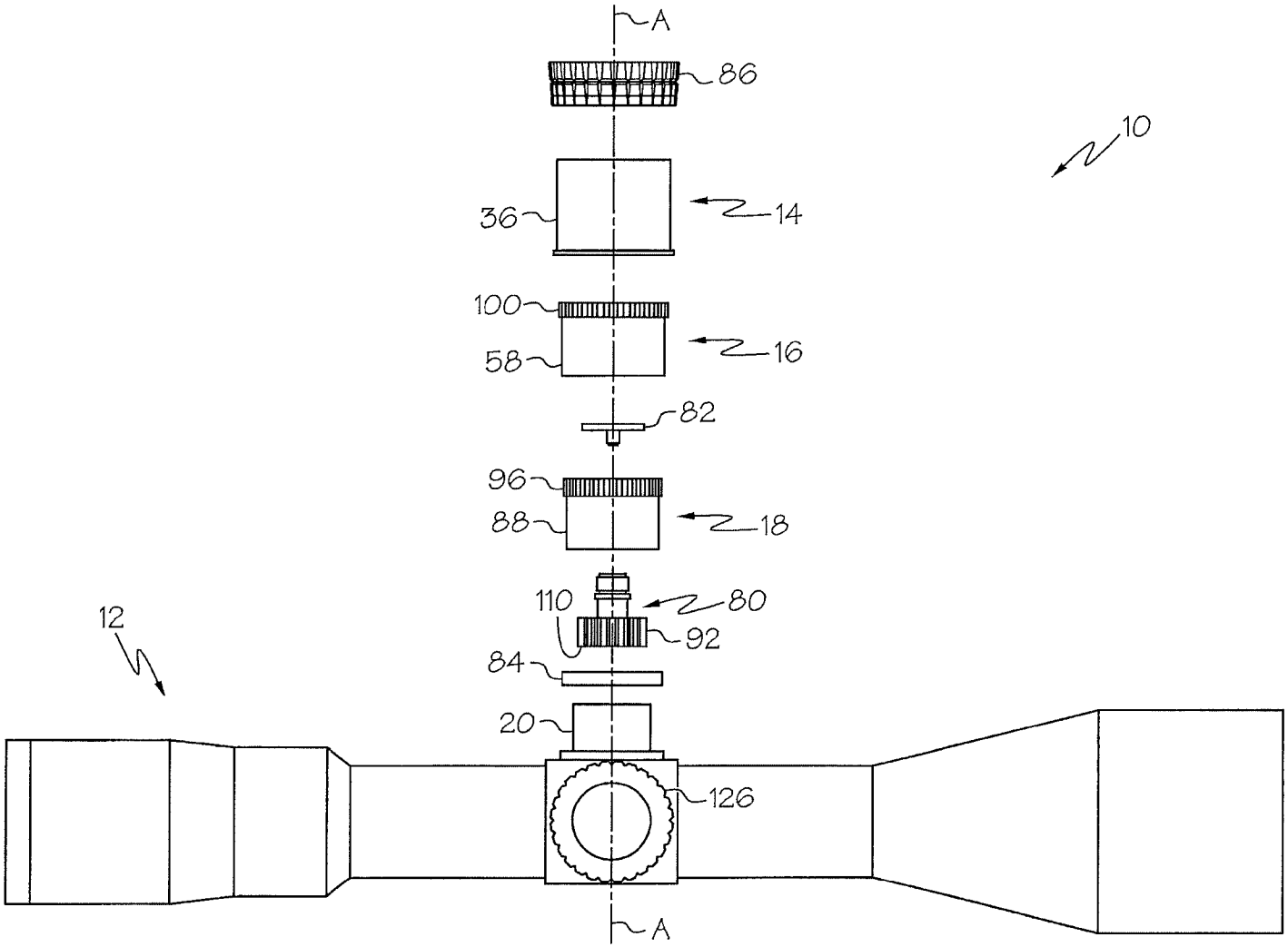
FIG. 5 is an exploded side view of an interlocking turret system constructed according to one embodiment of the present invention.
Figure 6:
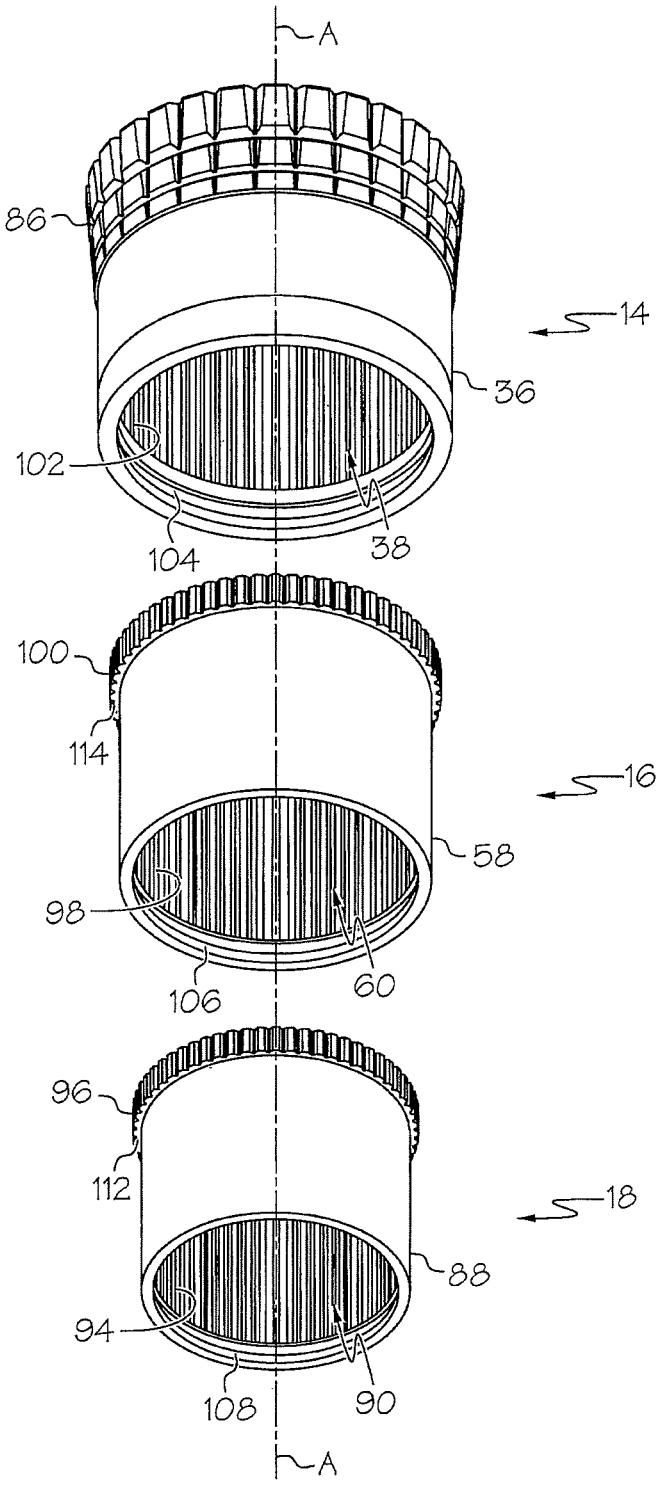
FIG. 6 is an exploded side perspective view of three turrets constructed according to one embodiment of the present invention.

Turning to FIG. 5, the turret system 10 is shown with at least a portion of its components exploded along a longitudinal axis A-A. As illustrated, the turret system 10 may be mounted to a base 20 of the scope 12. The turret system 10 may be selectively connected to a stem or spindle 80 in a variety of relative positions using, for example, a screw 82. In that manner, it will be understood that the turret system 10 may be calibrated to a zero point by connecting the turret system 10 to the spindle 80 at the zero point. A ring-shaped stop 84 may be provided which may be configured to limit the rotation or movement of the turret system 10. In particular, the stop 84 may optionally be configured to limit the rotation of the turret system 10 to one revolution or a fraction of a revolution, which may help avoid confusion relating to rotating the turret system 10 more than one time. In addition, this may allow the turret system 10 to be quickly returned to a minimum or maximum rotational position, if desired. It will be appreciated, however, that the stop 84 is not required and that the turret system 10 may be configured to rotate more than one revolution, if desired. A cap 86 or cover may optionally be provided and mounted to the first turret 14.

Turning to FIG. 6, the third turret 18 may include a hollow body comprising a sidewall 88 defining an internal cavity 90. In the embodiment shown, the spindle 80 may be partially or fully received or housed within the cavity 90 of the third turret's hollow body. As depicted in FIG. 5, the spindle 80 can include an external splined surface 92 suitable for mating engagement with a corresponding internal splined surface 94 of the third turret 18. In one embodiment, the spindle's splined surface 92 includes sixty (60) splines such that the turret system 10 can be set in any one of sixty (60) rotational positions. In another embodiment, the spindle's splined surface 92 includes ninety (90) splines such that the turret system 10 can be set in any one of ninety (90) rotational positions. Notwithstanding the foregoing, it will be appreciated that any suitable number of splines may be present on the spindle's splined surface 92. The third turret's splined surface 94 typically includes a number of splines equal to that of the spindle's external splined surface 92 so that the splined surfaces correspond to one another.

The third turret 18 can be partially or fully received or housed within the second turret 16. The third turret 18 may include an external splined surface 96 suitable for mating engagement with a corresponding internal splined surface 98 of the second turret 16. As demonstrated in FIG. 6, the external splined surface 96 may be provided solely at an upper end of the third turret 18, while the internal splined surface 98 may extend along a majority of the length of the second turret 16. The engagement of the splined surfaces 96 and 98 rotationally interlocks the third turret 18 with the second turret 16 such that the second and third turrets 16 and 18 are together rotatable relative to the scope 12. However, this engagement of the splined surfaces 96 and 98 still allows the second turret 16 to slide up and down axially relative to the third turret 18. The third turret's external splined surface 96 and the second turret's corresponding internal splined surface 98 may include any suitable number of splines (e.g., 60 splines, 90 splines or other number of splines) provided that the splined surfaces 96 and 98 may matingly engage one another.

Likewise, the second turret 16 can be partially or fully received or housed within the first turret 14. The second turret 16 may include an external splined surface 100 suitable for mating engagement with a corresponding internal splined surface 102 of the first turret 14. As demonstrated in FIG. 6, the external splined surface 100 may be provided solely at an upper end of the second turret 16, while the internal splined surface 102 may extend along a majority of the length of the first turret 14. The engagement of the splined surfaces 100 and 102 rotationally interlocks the second turret 16 with the first turret 14 such that the first and second turrets 14 and 16 are together rotatable relative to the scope 12. In other words, when a user turns one turret (e.g., the first turret 14), the entire stack of turrets 14, 16 and 18 is turned, thereby also turning the internal stem or spindle 80 in order to adjust the scope 12. However, this engagement of the splined surfaces 100 and 102 still allows the first turret 14 to slide up and down axially relative to the second turret 16. Notwithstanding the foregoing, it will be appreciated that any form of suitable projections and recesses may be substituted for the splined surfaces described herein. Such projections and recesses should, in one embodiment, rotationally interlock the turrets 14, 16 and 18 together, yet still allow the first and second turrets 14 and 16 to be slid up and down axially relative to one another and relative to the third turret 18. The second turret's external splined surface 100 and the first turret's corresponding internal splined surface 102 may include any suitable number of splines (e.g., 60 splines, 90 splines or other number of splines) provided that the splined surfaces 100 and 102 may matingly engage one another.

It will be appreciated that the configuration described herein where a third turret 18 is received or housed within a second turret 16, both of which may be in turn received or housed within a first turret 14, advantageously results in a turret system 10 that includes a plurality of turrets that may be contained within a relatively low profile or volume during transport and storage. It will also be appreciated that the configuration described herein allows a user to slide one of the turrets off and reattached it a click or two offset in one direction or the other, for example, in order to "cheat" the turret one direction or the other upon a change in shooting conditions (e.g., a change in altitude or temperature).

Referring still to FIG. 6, it is shown that the turrets 14, 16 and 18 can each include an internal groove 104, 106 and 108, respectively, that is at least partially circumferentially formed adjacent a lower end of the respective sidewalls 36, 58 and 88. The grooves 104, 106 and 108 may be configured for receiving an O-ring, snap ring or other suitable object therein to function as a stop in order to retain the turrets 14, 16 and 18 in an assembled state and to prevent them from being unintentionally pulled apart. Alternatively, an inwardly directed projection or ring (not shown) may be provided adjacent a lower end of each sidewall 36, 58 and 88 to serve the same purpose. In either case, the stops, whether in the form of O-rings, snap rings, projections or other objects may be respectively suitable for engaging a bottom surface 110 of the spindle 80 and the bottom surfaces 112 and 114 of the exterior projections or splines 96 and 100 to prevent the turrets 14, 16 and 18 from being unintentionally pulled apart. When O-rings are used, the O-rings may contact the outer surfaces of the second and third turret's sidewalls 58 and 88 to provide a degree of stability and light friction. This degree of light friction retains the first and second turrets 14 and 16 in their extended or raised positions even after the user releases grip of the turrets 14 or 16. The turrets 14, 16 and 18 of the turret system 10 are all connected to one another thereby eliminating the risk that one or more of them may become lost when not in use.

During assembly, the spindle 80 may be inserted into the third turret 18 by sliding the spindle 80 downwardly from a top end of the third turret 18. Similarly, the third turret 18 may be may be inserted into the second turret 16 by sliding the third turret 18 downwardly from a top end of the second turret 16. Likewise, the second turret 16 may be may be inserted into the first turret 14 by sliding the second turret 16 downwardly from a top end of the first turret 14.

Figure 7:
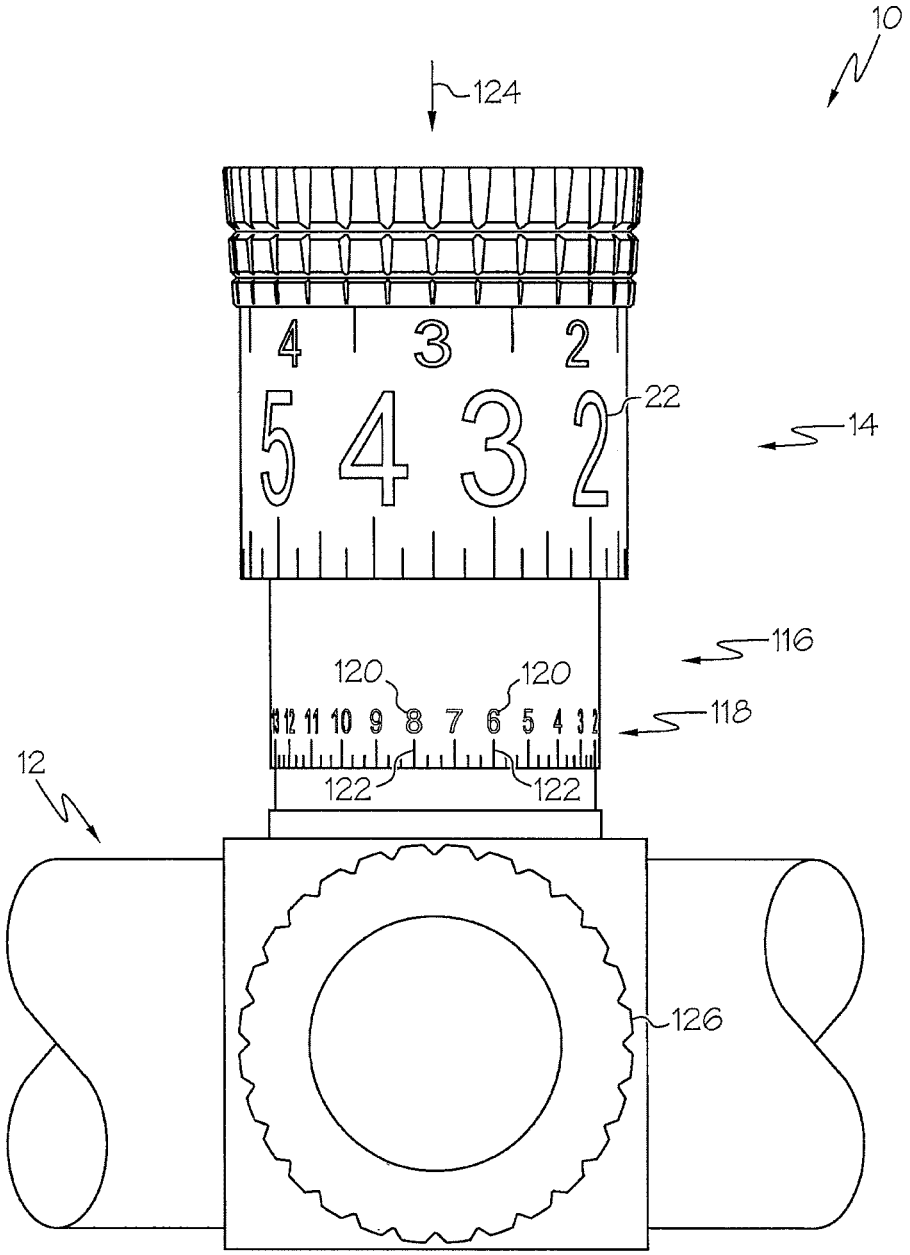
FIG. 7 is a side view of an interlocking turret system constructed according to another embodiment of the present invention illustrating the turrets in an expanded orientation.

Turning now to FIG. 7, another exemplary embodiment of the turret system 10 is illustrated. In this embodiment another variation of a second turret 116 is provided with a fourth set of set of calibration data 118. As shown, the fourth set of set of calibration data 118 in this embodiment includes minute of angle (MOA) data. The MOA data may correspond to or be independent from the first set of calibration data 22 of the first turret 14. In other words, the fourth set of set of calibration data 118 may be based on the same set on shooting conditions as the first set of calibration data 22 or may be based on a different set of shooting conditions, if desired. As shown, the MOA data can include one or more numbers 120, symbols or reference marks 122. With this embodiment, if the shooting conditions are outside the range of shooting conditions for which the first turret 14 is adapted to be used, the user may refer to a personal digital assistant (PDA), computer, smartphone, other electronic device or a chart in order to determine how far to turn the turret system 10 in terms of MOA and may use the MOA data provided on the second turret 116 to make such an adjustment to the scope 12. This may be especially beneficial in military applications. As indicated by arrow 124 in FIG. 7, the first turret 14 may be selectively pushed downwardly to a fully collapsed or partially collapsed position in order to re-cover the fourth turret 116.

While the embodiments of the turret system 10 depicted in the figures are shown as mounted to the top of the scope 12 for use in connection with distance adjustments (also known as elevation adjustments), another embodiment of the turret system 10 may be mounted at a location on the side of the scope 12 for use in connection with windage adjustments in substitution of the knob 126 shown in the figures. In other words, the turret system 10 may be implemented for adjusting scope 12 about a yaw axis, as opposed to a pitch axis as when it is mounted to the top of the scope 12. In this embodiment, the turrets of the turret system 10 may have calibration data included thereon related to windage.

Other and further embodiments are also within the scope of the present invention. For example, in an alternative embodiment, the sidewall 36 of the first turret 14 may be constructed of a generally clear or at least partially transparent material such that the second set of calibration data 42 included on the second turret 16 may be visible through the first turret 14. In this embodiment, the user could simultaneously view a first set of calibration data 22 and a second set of calibration data 42 without having to pull the first turret 14 up. In other embodiments, it will be understood that the stack of turrets 14, 16 and 18 may be inverted from that illustrated in the figures. In other words, the configuration of turrets shown in FIG. 6 may, in one embodiment, be turned upside down. In such an embodiment, the first turret 14 may be located at the base 20, the second turret 16 may be selectively extended upwardly from the first turret 14 and the third turret 18 may be selectively extended upwardly from the second turret 16.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A turret system for a firearm scope, said turret system comprising:

a first turret having a first set of calibration data, and at least one of a projection extending from an inner surface of said first turret and a recess defined in the inner surface of said first turret; and a second turret having a second set of calibration data, and at least one of a recess defined in an outer surface of said second turret and a projection extending from the outer surface of said second turret;

wherein said second turret is at least partially received within said first turret;

wherein said first turret is selectively movable between an extended position and a collapsed position;

wherein the at least one of a projection and recess of said first turret corresponds and is engaged with the at least one of a recess and projection of said second turret to rotationally interlock said first turret with said second turret;

wherein said first turret is rotationally interlocked with said second turret when said first turret is in said extended position.

2. The turret system of claim 1, wherein said first turret comprises a hollow body and said second turret is at least partially received within said hollow body of said first turret.

3. The turret system of claim 1, wherein said first turret is selectively axially movable relative to said second turret.

4. The turret system of claim 1, wherein said first turret is selectively movable between a raised position and a lowered position.

5. The turret system of claim 4, wherein said second turret is at least partially exposed when said first turret is in said raised position and said second turret is substantially covered when said first turret is in said lowered position.

6. The turret system of claim 4, wherein said second set of calibration data of said second turret is exposed when said first turret is in said raised position and said second set of calibration data of said second turret is substantially covered when said first turret is in said lowered position.

7. The turret system of claim 1, wherein said first set of calibration data is customized for a first set of shooting conditions and said second set of calibration data is customized for a second set of shooting conditions.

8. The turret system of claim 1, wherein said first set of calibration data includes a first set of distance indictors and said second set of calibration data includes a second set of distance indictors.

9. The turret system of claim 8, wherein said first set of calibration data further includes a first set of windage hold-off indictors and said second set of calibration data further includes a second set of windage hold-off indictors.

10. The turret system of claim 1, wherein said first set of calibration data includes a first set of distance indictors and said second set of calibration data includes minute of angle (MOA) data.

11. The turret system of claim 1, wherein both said first turret and said second turret are rotatable relative to said scope.

12. The turret system of claim 1, wherein said first turret is rotationally interlocked with said second turret such that said first and second turrets are together rotatable relative to said scope.

13. The turret system of claim 1, wherein the at least one of a projection and recess of said first turret is axially extending and wherein the at least one of a recess and projection of said second turret is axially extending.

14. The turret system of claim 1 further comprising a third turret having a third set of calibration data, wherein said third turret is at least partially received within said second turret.

15. The turret system of claim 14, wherein said second turret is selectively movable between an extended position and a collapsed position and wherein said third turret is at least partially exposed when said second turret is in said extended position and said third turret is substantially covered when said second turret is in said collapsed position.

16. A turret system for a firearm scope, said turret system comprising:

a first turret having a hollow body, a first set of calibration data, and at least one of a projection extending from an inner surface of said first turret and a recess defined in the inner surface of said first turret; and a second turret having a second set of calibration data, and at least one of a recess defined in an outer surface of said second turret and a projection extending from the outer surface of said second turret, said second turret being at least partially received within said hollow body of said first turret;

wherein said first turret is axially movable relative to said second turret, said first turret being selectively movable between an extended position and a collapsed position;

wherein the at least one of a projection and recess of said first turret corresponds and is engaged with the at least one of a recess and projection of said second turret to rotationally interlock said first turret with said second turret;

wherein said first turret is rotationally interlocked with said second turret when said first turret is in said extended position and when said first turret is in said collapsed position;

wherein said second turret is at least partially exposed when said first turret is in said extended position and said second turret is substantially covered when said first turret is in said collapsed position.

17. A firearm scope comprising:

a turret assembly that includes a first turret having a first set of calibration data, and at least one of a projection extending from an inner surface of said first turret and a recess defined in the inner surface of said first turret; and a second turret having a second set of calibration data, and at least one of a recess defined in an outer surface of said second turret and a projection extending from the outer surface of said second turret;

wherein said second turret is at least partially received within said first turret;

wherein said first turret is selectively movable between an extended position and a collapsed position;

wherein the at least one of a projection and recess of said first turret corresponds and is engaged with the at least one of a recess and projection of said second turret to rotationally interlock said first turret with said second turret;

wherein when said first turret is in said extended position, said first turret is rotationally interlocked with said second turret.

18. The scope of claim 17, wherein said first turret is axially movable relative to said second turret.

19. The scope of claim 18, wherein said second turret is at least partially exposed when said first turret is in said extended position and said second turret is substantially covered when said first turret is in said collapsed position.

20. The turret system of claim 1, wherein said first turret is rotationally interlocked with said second turret when said first turret is in said collapsed position.

21. The turret system of claim 1, wherein the at least one of a recess and projection of said second turret is axially extending.

22. The turret system of claim 1, wherein the at least one of a projection and recess of said first turret is axially extending.

* * * * *